US011920580B2

(12) United States Patent
Otono et al.

(10) Patent No.: US 11,920,580 B2
(45) Date of Patent: Mar. 5, 2024

(54) BELLOWS PUMP DEVICE

(71) Applicant: NIPPON PILLAR PACKING CO., LTD., Osaka (JP)

(72) Inventors: Yuki Otono, Osaka (JP); Ai Tomotoshi, Osaka (JP); Kazukiyo Teshima, Osaka (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 193 days.

(21) Appl. No.: 17/641,341

(22) PCT Filed: Jun. 12, 2020

(86) PCT No.: PCT/JP2020/023147
§ 371 (c)(1),
(2) Date: Mar. 8, 2022

(87) PCT Pub. No.: WO2021/049115
PCT Pub. Date: Mar. 18, 2021

(65) Prior Publication Data

US 2022/0341414 A1 Oct. 27, 2022

(30) Foreign Application Priority Data

Sep. 9, 2019 (JP) ..... 2019-163783

(51) Int. Cl.
*F04B 49/02* (2006.01)
*F04B 43/00* (2006.01)
(Continued)

(52) U.S. Cl.
CPC ..... *F04B 49/02* (2013.01); *F04B 43/0081* (2013.01); *F04B 43/086* (2013.01);
(Continued)

(58) Field of Classification Search
CPC .... F04B 43/10; F04B 45/022; F04B 45/0336; F04B 2201/0201; F04B 43/0081;
(Continued)

(56) References Cited

U.S. PATENT DOCUMENTS 5,224,841 A * 7/1993 Thompson ..... F04B 43/1136 92/37
10,718,324 B2 * 7/2020 Nakano ..... F04B 45/022
(Continued)

FOREIGN PATENT DOCUMENTS

JP 2012211512 A 11/2012
JP 2015034481 A 2/2015
JP 2017219015 A 12/2017

OTHER PUBLICATIONS

English Translation of International Search Report for PCT/JP2020/023147 dated Aug. 25, 2020.
(Continued)

*Primary Examiner* — Dominick L Plakkoottam
(74) *Attorney, Agent, or Firm* — Millen, White, Zelano & Branigan P.C.; William F. Nixon

(57) ABSTRACT

A bellows pump device includes a control unit which, before operation of the bellows pump device is started, performs initial control in which solenoid valves are switched and pressurized air is supplied to suction-side air chambers in advance, thereby determining operation air pressures which are air pressures of the pressurized air to be supplied to the suction-side air chambers during the operation. As the initial control, the control unit outputs control commands to electropneumatic regulators so as to gradually increase the air pressures of the pressurized air to be supplied to the suction-side air chambers in advance, and when detection signals resulting from detection of expansion positions of the bellows are inputted from the proximity sensors to the control unit, the control unit determines the air pressures of the
(Continued)

pressurized air supplied to the suction-side air chambers at that time as the operation air pressures.

6 Claims, 6 Drawing Sheets

(51) Int. Cl.

| | |
|---|---|
| ***F04B 43/08*** | (2006.01) |
| ***F04B 43/10*** | (2006.01) |
| ***F04B 43/113*** | (2006.01) |
| ***F04B 45/02*** | (2006.01) |
| ***F04B 45/033*** | (2006.01) |
| ***F04B 49/03*** | (2006.01) |
| ***F04B 49/22*** | (2006.01) |

(52) U.S. Cl.
CPC ..... *F04B 43/10* (2013.01); *F04B 43/113* (2013.01); *F04B 45/022* (2013.01); *F04B 45/0336* (2013.01); *F04B 49/03* (2013.01); *F04B 49/22* (2013.01); *F04B 2201/0201* (2013.01)

(58) Field of Classification Search
CPC ..... F04B 53/10; F04B 43/084; F04B 43/086; F04B 45/02; F04B 49/02; F04B 49/03; F04B 43/113; F04B 49/22; F04B 43/1136; F04B 49/16
See application file for complete search history.

(56) References Cited

U.S. PATENT DOCUMENTS

| | | | | |
|---|---|---|---|---|
| 2004/0037722 | A1* | 2/2004 | Watanabe | F04B 43/084 417/473 |
| 2004/0170511 | A1* | 9/2004 | Teshima | F04B 43/08 417/472 |
| 2006/0165541 | A1* | 7/2006 | Teshima | F04B 43/10 417/472 |
| 2014/0010689 | A1* | 1/2014 | Iwabuchi | F04B 43/1136 417/472 |
| 2017/0152869 | A1* | 6/2017 | Sakai | F04B 43/0081 |
| 2017/0191476 | A1* | 7/2017 | Matsuda | F04B 53/10 |
| 2017/0218946 | A1* | 8/2017 | Yamada | F04B 49/06 |

OTHER PUBLICATIONS

English Machine Translation of JP2017219015, Publication Date: Dec. 14, 2017.
English Machine Translation of JP2015034481, Publication Date: Feb. 19, 2015.

* cited by examiner

BELLOWS PUMP DEVICE

TECHNICAL FIELD

The present invention relates to a bellows pump device.

BACKGROUND ART

As a bellows pump used for feeding a transport fluid such as a chemical solution or a solvent in semiconductor production, chemical industries, or the like, a bellows pump in which two air chambers are formed by connecting pump cases at both sides of a pump head and a pair of bellows that are expandable/contractible independently of each other are provided inside these air chambers and which is configured to cause each bellows to contract or expand by alternately supplying pressurized air to each air chamber, is known (see, for example, PATENT LITERATURE 1).

In the bellows pump described in PATENT LITERATURE 1, when one bellows of the pair of bellows contracts, the transport fluid is sucked into the one bellows, and at the same time, when the other bellows expands, the transport fluid within the other bellows is discharged. In addition, when the other bellows contracts, the transport fluid is sucked into the other bellows, and at the same time, when the one bellows expands, the transport fluid within the one bellows is discharged.

CITATION LIST

[Patent Literature]

PATENT LITERATURE 1: Japanese Laid-Open Patent Publication No. 2012-211512

SUMMARY OF THE INVENTION

Technical Problem

In the above bellows pump, the air pressure of the pressurized air to be supplied to each air chamber in order to cause each of the pair of bellows to expand at the start of operation of the bellows pump is set to a constant pressure value. However, the air pressure (appropriate air pressure) of the pressurized air required to cause the bellows to expand fluctuates according to the flow rate of the transport fluid sucked into the bellows, etc. Therefore, if the constant pressure value becomes excessively higher than the appropriate air pressure, a large negative pressure is generated inside the bellows. Then, an impact pressure called "water hammer" may be generated, or cavitation may occur, in a suction pipe through which the transport fluid is sucked into the bellows, which may adversely affect a semiconductor manufacturing process or the like.

The present invention has been made in view of such circumstances, and an object of the present invention is to provide a bellows pump device that can inhibit an impact pressure and the like from being generated when a transport fluid is sucked into a bellows at start of operation.

Solution to Problem (1) The present invention is directed to a bellows pump device including a fluid chamber to and from which a pressurized fluid is supplied and discharged and an expandable/contractible bellows, the bellows expanding to a predetermined expansion position and a transport fluid being sucked into the bellows when the pressurized fluid is supplied to the fluid chamber, the bellows contracting and the transport fluid within the bellows being discharged when the pressurized fluid is discharged from the fluid chamber, the bellows pump device further including: a solenoid valve configured to switch supply/discharge of the pressurized fluid to/from the fluid chamber; a fluid pressure adjustment unit configured to adjust a fluid pressure of the pressurized fluid to be supplied to the fluid chamber; a detection unit configured to detect that the bellows is at the expansion position, and output a detection signal; and a control unit configured to, before operation of the bellows pump device is started, perform initial control in which the solenoid valve is switched and the pressurized fluid is supplied to the fluid chamber in advance, thereby determining an operation fluid pressure which is the fluid pressure of the pressurized fluid to be supplied to the fluid chamber during the operation, wherein, as the initial control, the control unit outputs a control command to the fluid pressure adjustment unit so as to gradually increase the fluid pressure of the pressurized fluid to be supplied to the fluid chamber in advance, and when the detection signal is inputted from the detection unit to the control unit, the control unit determines the fluid pressure of the pressurized fluid supplied to the fluid chamber at that time as the operation fluid pressure.

In the bellows pump device configured as described above, before the operation is started, the control unit performs the initial control in which the pressurized fluid is supplied to the fluid chamber in advance, thereby determining the operation fluid pressure which is the fluid pressure of the pressurized fluid to be supplied to the fluid chamber during the operation. At that time, the control unit outputs the control command to the fluid pressure adjustment unit so as to gradually increase the fluid pressure of the pressurized fluid, and when the bellows expands to the expansion position and the detection signal is inputted from the detection unit to the control unit, the control unit determines the fluid pressure of the pressurized fluid supplied to the fluid chamber at that time, as the operation fluid pressure. Accordingly, the operation fluid pressure becomes a value near the appropriate fluid pressure required to cause the bellows to expand to the expansion position. Therefore, an impact pressure and the like can be inhibited from being generated when the transport fluid is sucked into the bellows at the start of the operation.

(2) Preferably, the control unit outputs a control command to the fluid pressure adjustment unit so as to increase stepwise the fluid pressure of the pressurized fluid to be supplied to the fluid chamber in advance.

In this case, the control unit can determine a value closer to the appropriate fluid pressure as the operation fluid pressure as compared to the case of continuously increasing the fluid pressure.

(3) Preferably, the bellows pump device further includes an operation switch configured to output an operation command to start the operation, and when the operation command is inputted to the control unit, the control unit starts the operation after performing the initial control.

In this case, the control unit can assuredly perform the initial control before starting the operation of the bellows pump device.

(4) Preferably, the bellows pump device includes a first fluid chamber and a second fluid chamber as the fluid chamber, includes, as the bellows, a first bellows configured to suck and discharge the transport fluid when the pressurized fluid is supplied to and discharged from the first fluid chamber and a second bellows expandable/contractible independently of the first bellows and configured to suck and discharge the transport fluid when the pressurized fluid is supplied to and discharged from the second fluid chamber, includes, as the solenoid valve, a first solenoid valve configured to switch supply/discharge of the pressurized fluid to/from the first fluid chamber and a second solenoid valve configured to switch supply/discharge of the pressurized fluid to/from the second fluid chamber, includes, as the fluid pressure adjustment unit, a first fluid pressure adjustment unit configured to adjust the fluid pressure of the pressurized fluid to be supplied to the first fluid chamber and a second fluid pressure adjustment unit configured to adjust the fluid pressure of the pressurized fluid to be supplied to the second fluid chamber, and includes, as the detection unit, a first detection unit configured to detect that the first bellows is at the expansion position and output a detection signal and a second detection unit configured to detect that the second bellows is at the expansion position and output a detection signal; as the initial control, the control unit performs first initial control in which the first solenoid valve is switched and the pressurized fluid is supplied to the first fluid chamber in advance, thereby determining a first operation fluid pressure which is the fluid pressure of the pressurized fluid to be supplied to the first fluid chamber during the operation, and second initial control in which the second solenoid valve is switched and the pressurized fluid is supplied to the second fluid chamber in advance, thereby determining a second operation fluid pressure which is the fluid pressure of the pressurized fluid to be supplied to the second fluid chamber during the operation; as the first initial control, the control unit outputs a control command to the first fluid pressure adjustment unit so as to gradually increase the fluid pressure of the pressurized fluid to be supplied to the first fluid chamber in advance, and when the detection signal is inputted from the first detection unit to the control unit, the control unit determines the fluid pressure of the pressurized fluid supplied to the first fluid chamber at that time as the first operation fluid pressure; and as the second initial control, the control unit outputs a control command to the second fluid pressure adjustment unit so as to gradually increase the fluid pressure of the pressurized fluid to be supplied to the second fluid chamber in advance, and when the detection signal is inputted from the second detection unit to the control unit, the control unit determines the fluid pressure of the pressurized fluid supplied to the second fluid chamber at that time as the second operation fluid pressure.

In this case, the first operation fluid pressure becomes a value near the appropriate fluid pressure required to cause the first bellows to expand to the expansion position, and the second operation fluid pressure becomes a value near the appropriate fluid pressure required to cause the second bellows to expand to the expansion position. Therefore, an impact pressure and the like can be inhibited from being generated when the transport fluid is sucked into the first bellows and the second bellows at the start of the operation.

(5) Preferably, the control unit performs the second initial control after performing the first initial control.

For example, when the first bellows and the second bellows expand and contract independently of each other, the control unit can simultaneously perform the first initial control and the second initial control. However, since the first bellows and the second bellows are caused to alternately expand during actual operation, when the first initial control and the second initial control are simultaneously performed, the first bellows and the second bellows simultaneously expand. Therefore, when the first initial control and the second initial control are simultaneously performed, the negative pressure in each bellows becomes larger than that during actual operation, and the fluid pressure of the pressurized fluid required to cause each bellows to expand to the expansion position becomes higher than the appropriate fluid pressure required during actual operation. Accordingly, the first operation fluid pressure and the second operation fluid pressure determined by the control unit are also higher than the appropriate fluid pressure.

On the other hand, in the above (5), since the second initial control is performed after the first initial control is performed, the first operation fluid pressure and the second operation fluid pressure can be determined in the same environment as during actual operation. As a result, the control unit can determine values closer to the appropriate fluid pressure as the first and second operation fluid pressures, as compared to the case where the first initial control and the second initial control are simultaneously performed.

(6) Preferably, in the second initial control, the control unit outputs the control command so as to gradually increase the fluid pressure of the pressurized fluid to be supplied to the second fluid chamber in advance from the first operation fluid pressure determined in the first initial control.

In this case, the control unit can quickly determine the second operation fluid pressure in the second initial control.

Advantageous Effects of the Invention

In the bellows pump device of the present invention, an impact pressure and the like can be inhibited from being generated when the transport fluid is sucked into the bellows at the start of the operation.

DETAILED DESCRIPTION

Next, preferred embodiments of the present invention will be described with reference to the accompanying drawings.

[Entire Configuration of Bellows Pump Device]

Figure 1:
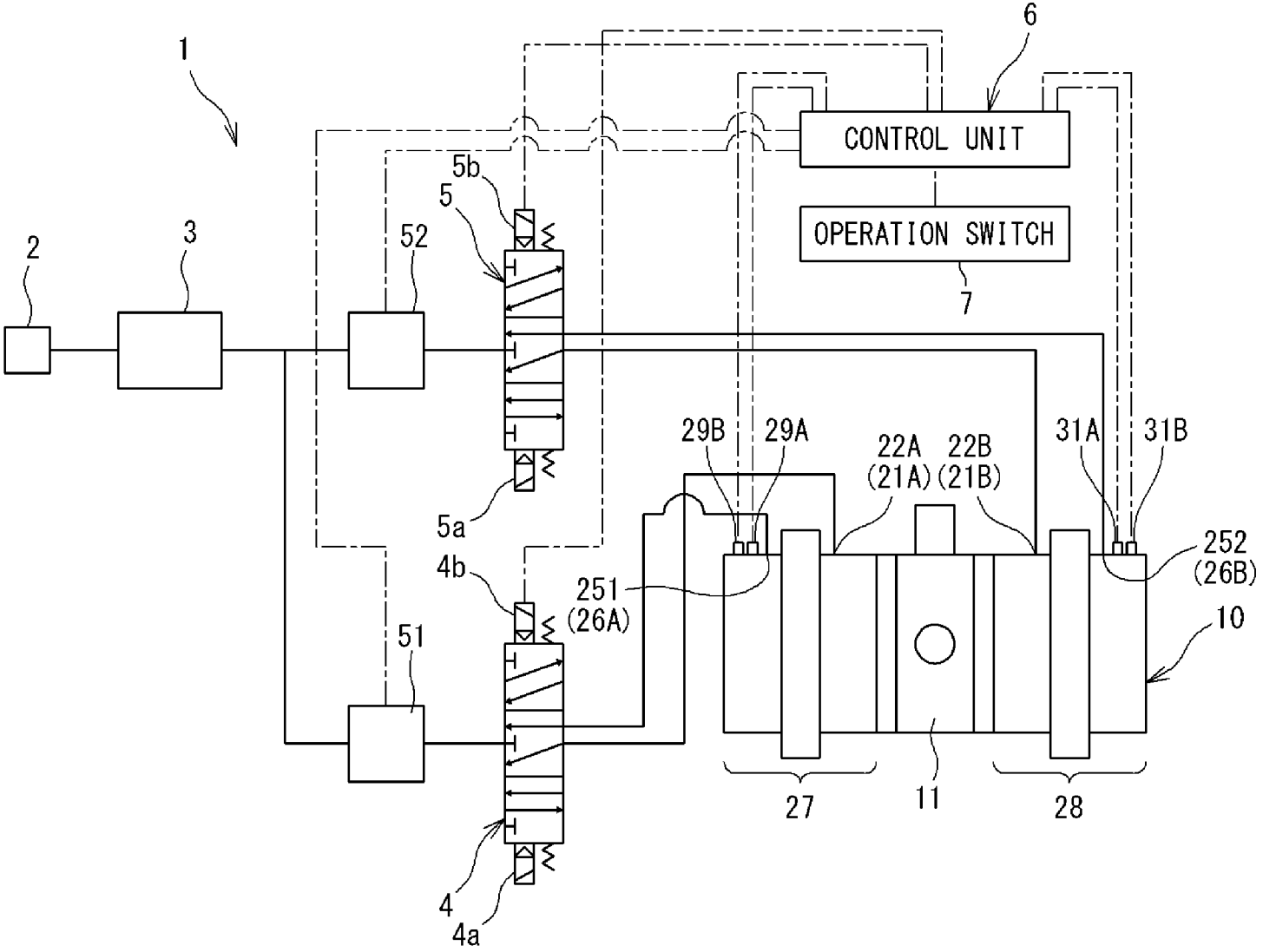
FIG. 1 is a schematic configuration diagram of a bellows pump device according to an embodiment of the present invention.

FIG. 1 is a schematic configuration diagram of a bellows pump device according to an embodiment of the present invention. A bellows pump device 1 of the present embodiment is used, for example, in a semiconductor production apparatus when a transport fluid such as a chemical solution or a solvent is supplied in a certain amount. The bellows pump device 1 includes an air supply device (fluid supply device) 2, a mechanical regulator 3, a first solenoid valve 4, a second solenoid valve 5, a control unit 6, an operation switch 7, a bellows pump 10, a first electropneumatic regulator (first fluid pressure adjustment unit) 51, and a second electropneumatic regulator (second fluid pressure adjustment unit) 52.

The air supply device 2 is composed of, for example, an air compressor and generates pressurized air (pressurized fluid) to be supplied to the bellows pump 10. The mechanical regulator 3 adjusts the air pressure (fluid pressure) of the pressurized air generated by the air supply device 2. The operation switch 7 is a switch that outputs an operation command to start the operation of the bellows pump device 1. When an operator turns on the operation switch 7, the operation switch 7 outputs the operation command to the control unit 6.

Figure 2:
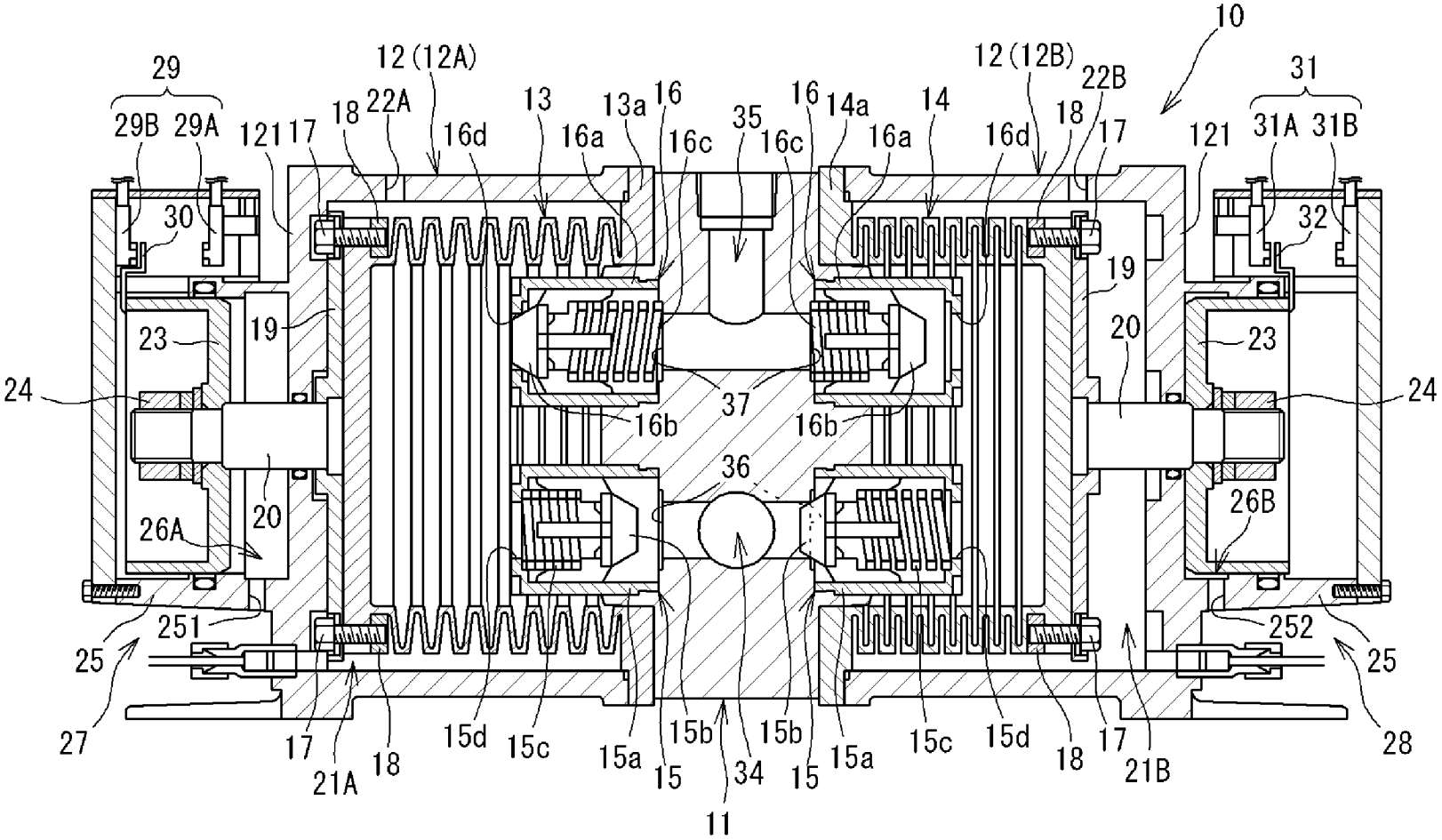
FIG. 2 is a cross-sectional view of a bellows pump.

FIG. 2 is a cross-sectional view of the bellows pump 10 according to the present embodiment. The bellows pump 10 of the present embodiment includes: a pump head 11 which is disposed at a center portion; a pair of pump cases 12 which are mounted at both sides of the pump head 11 in a right-left direction; a first bellows 13 and a second bellows 14 which are mounted on side surfaces of the pump head 11 in the right-left direction and within the respective pump cases 12; and a total of four check valves 15 and 16 which are mounted on the side surfaces of the pump head 11 in the right-left direction and within the respective first and second bellows 13 and 14.

[Configurations of Bellows]

The first bellows 13 and the second bellows 14 are each formed in a bottomed cylindrical shape from a fluorine resin such as polytetrafluoroethylene (PTFE) or a tetrafluoroethylene-perfluoro alkyl vinyl ether copolymer (PFA). A flange portion 13*a* and a flange portion 14*a* are integrally formed at open-side end portions of the first and second bellows 13 and 14 and are hermetically pressed and fixed to the side surfaces of the pump head 11. Peripheral walls of the first and second bellows 13 and 14 are each formed in an accordion shape, and are configured to be expandable/contractible independently of each other in the right-left direction.

A working plate 19 is fixed to each of the outer surfaces of closed-side end portions of the first and second bellows 13 and 14 by bolts 17 and nuts 18. Each of the first and second bellows 13 and 14 is expandable/contractible between a most expanded position where the outer surface of the working plate 19 is in contact with the inner surface of a bottom wall portion 121 of the pump case 12 having a bottomed cylindrical shape and a most contracted position where the inner surface of a piston body 23 described later is in contact with the outer surface of the bottom wall portion 121.

[Configurations of Pump Cases]

An opening peripheral portion of the pump case 12 (hereinafter, also referred to as "first pump case 12A") is hermetically pressed and fixed to the flange portion 13*a* of the first bellows 13. Accordingly, a first discharge-side air chamber 21A is formed at the outer side of the first bellows 13 within the first pump case 12A such that a hermetic state thereof is maintained.

A first suction/discharge port 22A is provided in the first pump case 12A and connected to the air supply device 2 via the first solenoid valve 4, the first electropneumatic regulator 51, and the mechanical regulator 3 (see FIG. 1). Accordingly, when the pressurized air is supplied from the air supply device 2 to the interior of the first discharge-side air chamber 21A, the first bellows 13 contracts to the most contracted position.

An opening peripheral portion of the pump case 12 (hereinafter, also referred to as "second pump case 12B") is hermetically pressed and fixed to the flange portion 14*a* of the second bellows 14. Accordingly, a second discharge-side air chamber 21B is formed at the outer side of the second bellows 14 within the second pump case 12B such that a hermetic state thereof is maintained.

A second suction/discharge port 22B is provided in the second pump case 12B and connected to the air supply device 2 via the second solenoid valve 5, the second electropneumatic regulator 52, and the mechanical regulator 3 (see FIG. 1). Accordingly, when the pressurized air is supplied from the air supply device 2 to the interior of the second discharge-side air chamber 21B, the second bellows 14 contracts to the most contracted position.

A rod-shaped connection member 20 penetrates the bottom wall portion 121 of each pump case 12A, 12B and is supported so as to be slidable in the right-left direction relative to the bottom wall portion 121. The piston body 23 is fixed to an outer end portion of the connection member 20 by a nut 24. The piston body 23 is supported so as to be slidable in the right-left direction relative to an inner circumferential surface of a cylindrical cylinder body 25, which is integrally provided at the outer side of the bottom wall portion 121, with a hermetic state maintained.

Accordingly, at the first pump case 12A side, a space surrounded by the bottom wall portion 121, the cylinder body 25, and the piston body 23 is formed as a first suction-side air chamber 26A of which a hermetic state is maintained. In addition, at the second pump case 12B side, a space surrounded by the bottom wall portion 121, the cylinder body 25, and the piston body 23 is formed as a second suction-side air chamber 26B of which a hermetic state is maintained.

In the cylinder body 25 at the first pump case 12A side, a suction/discharge port 251 is formed so as to communicate with the first suction-side air chamber 26A. The suction/discharge port 251 is connected to the air supply device 2 via the first solenoid valve 4, the first electropneumatic regulator 51, and the mechanical regulator 3 (see FIG. 1). Accordingly, when the pressurized air is supplied from the air supply device 2 to the interior of the first suction-side air chamber 26A via the suction/discharge port 251, the first bellows 13 expands to a predetermined expansion position. The first bellows 13 of the present embodiment expands, for example, to the most expanded position.

In the cylinder body 25 at the second pump case 12B side, a suction/discharge port 252 is formed so as to communicate with the second suction-side air chamber 26B. The suction/discharge port 252 is connected to the air supply device 2 via the second solenoid valve 5, the second electropneumatic regulator 52, and the mechanical regulator 3 (see FIG. 1). Accordingly, when the pressurized air is supplied from the air supply device 2 to the interior of the second suction-side air chamber 26B via the suction/discharge port 252, the second bellows 14 expands to a predetermined expansion position. The second bellows 14 of the present embodiment expands, for example, to the most expanded position.

Because of the above configuration, the first pump case 12A, in which the first discharge-side air chamber 21A is formed, and the piston body 23 and the cylinder body 25 that form the first suction-side air chamber 26A, form a first air cylinder unit (first driving unit) 27 which causes the first bellows 13 to perform expansion/contraction operation continuously between the most expanded position and the most contracted position.

In addition, the second pump case 12B, in which the second discharge-side air chamber 21B is formed, and the piston body 23 and the cylinder body 25 that form the second suction-side air chamber 26B, form a second air cylinder unit (second driving unit) 28 which causes the second bellows 14 to perform expansion/contraction operation continuously between the most expanded position and the most contracted position.

[Configurations of Detection Units]

A pair of proximity sensors 29A and 29B are mounted on the cylinder body 25 of the first air cylinder unit 27. A detection plate 30 to be detected by each of the proximity sensors 29A and 29B is mounted on the piston body 23 of the first air cylinder unit 27. The detection plate 30 reciprocates together with the piston body 23, so that the detection plate 30 alternately comes close to the proximity sensors 29A and 29B.

The proximity sensor 29A is disposed at such a position that the proximity sensor 29A detects the detection plate 30 when the first bellows 13 is at the most contracted position. The proximity sensor 29B is disposed at such a position that the proximity sensor 29B detects the detection plate 30 when the first bellows 13 is at the most expanded position. When the respective proximity sensors 29A and 29B detect the detection plate 30, the proximity sensors 29A and 29B output detection signals thereof to the control unit 6. The proximity sensor 29B functions as a first detection unit which detects the expansion position of the first bellows 13 and outputs a detection signal.

A pair of proximity sensors 31A and 31B are mounted on the cylinder body 25 of the second air cylinder unit 28. A detection plate 32 to be detected by each of the proximity sensors 31A and 31B is mounted on the piston body 23 of the second air cylinder unit 28. The detection plate 32 reciprocates together with the piston body 23, so that the detection plate 32 alternately comes close to the proximity sensors 31A and 31B.

The proximity sensor 31A is disposed at such a position that the proximity sensor 31A detects the detection plate 32 when the second bellows 14 is at the most contracted position. The proximity sensor 31B is disposed at such a position that the proximity sensor 31B detects the detection plate 32 when the second bellows 14 is at the most expanded position. When the respective proximity sensors 31A and 31B detect the detection plate 30, the proximity sensors 31A and 31B output detection signals thereof to the control unit 6. The proximity sensor 31B functions as a second detection unit which detects the expansion position of the second bellows 14 and outputs a detection signal.

The first and second detection units are composed of the proximity sensors 29B and 31B, but may be composed of other detection means such as limit switches. In the following, when the common items between the proximity sensors 29A and 29B are described, the proximity sensors 29A and 29B are collectively referred to as proximity sensor 29. Similarly, when the common items between the proximity sensors 31A and 31B are described, the proximity sensors 31A and 31B are collectively referred to as proximity sensor 31.

[Configuration of Pump Head]

The pump head 11 is formed from a fluorine resin such as PTFE or PFA. A suction passage 34 and a discharge passage 35 for the transport fluid are formed within the pump head 11. The suction passage 34 and the discharge passage 35 are opened in an outer peripheral surface of the pump head 11 and respectively connected to a suction port and a discharge port (both are not shown) provided at the outer peripheral surface.

The suction port is connected to a storage tank for the transport fluid or the like, and the discharge port is connected to a transport destination for the transport fluid. In addition, the suction passage 34 and the discharge passage 35 each branch toward both right and left side surfaces of the pump head 11, and have suction openings 36 and discharge openings 37 which are opened in both right and left side surfaces of the pump head 11. Each suction opening 36 and each discharge opening 37 communicate with the interior of the bellows 13 or 14 via the check valves 15 and 16, respectively.

[Configurations of Check Valves]

The check valves 15 and 16 are provided at each suction opening 36 and each discharge opening 37.

The check valve 15 (hereinafter, also referred to as "suction check valve") mounted at each suction opening 36 includes: a valve case 15*a*; a valve body 15*b* which is housed in the valve case 15*a*; and a compression coil spring 15*c* which biases the valve body 15*b* in a valve closing direction.

The valve case 15*a* is formed in a bottomed cylindrical shape. A through hole 15*d* is formed in a bottom wall of the valve case 15*a* so as to communicate with the interior of the bellows 13 or 14. The valve body 15*b* closes the suction opening 36 (performs valve closing) by the biasing force of the compression coil spring 15*c*, and opens the suction opening 36 (performs valve opening) when a back pressure generated by flow of the transport fluid occurring with expansion/contraction of the bellows 13 or 14 acts thereon.

Accordingly, the suction check valve 15 opens, when the bellows 13 or 14 at which the suction check valve 15 is disposed expands, to permit suction of the transport fluid in a direction from the suction passage 34 toward the interior of the bellows 13 or 14 (in one direction). In addition, the suction check valve 15 closes, when the bellows 13 or 14 at which the suction check valve 15 is disposed contracts, to block backflow of the transport fluid in a direction from the interior of the bellows 13 or 14 toward the suction passage 34 (in another direction).

The check valve 16 (hereinafter, also referred to as "discharge check valve") mounted at each discharge opening 37 includes: a valve case 16*a*; a valve body 16*b* which is housed in the valve case 16*a*; and a compression coil spring 16*c* which biases the valve body 16*b* in a valve closing direction.

The valve case 16*a* is formed in a bottomed cylindrical shape. A through hole 16*d* is formed in a bottom wall of the valve case 16*a* so as to communicate with the interior of the bellows 13 or 14. The valve body 16*b* closes the through hole 16*d* of the valve case 16*a* (performs valve closing) by the biasing force of the compression coil spring 16*c*, and opens the through hole 16*d* of the valve case 16*a* (performs valve opening) when a back pressure generated by flow of the transport fluid occurring with expansion/contraction of the bellows 13 or 14 acts thereon.

Accordingly, the discharge check valve 16 opens, when the bellows 13 or 14 at which the discharge check valve 16 is disposed contracts, to permit outflow of the transport fluid in a direction from the interior of the bellows 13 or 14 toward the discharge passage 35 (in one direction). In addition, the discharge check valve 16 closes, when the bellows 13 or 14 at which the discharge check valve 16 is disposed expands, to block backflow of the transport fluid in a direction from the discharge passage 35 toward the interior of the bellows 13 or 14 (in another direction).

[Operation of Bellows Pump]

Figure 3:
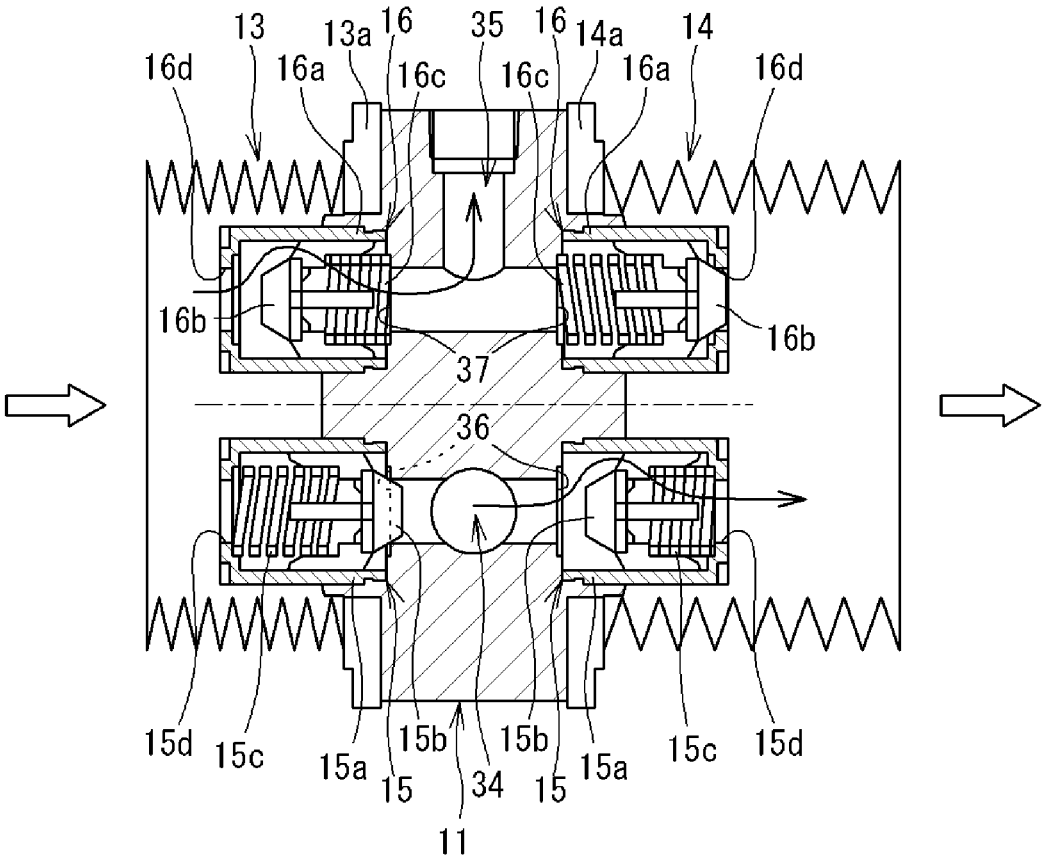
FIG. 3 is an explanatory diagram showing operation of the bellows pump.
Figure 4:
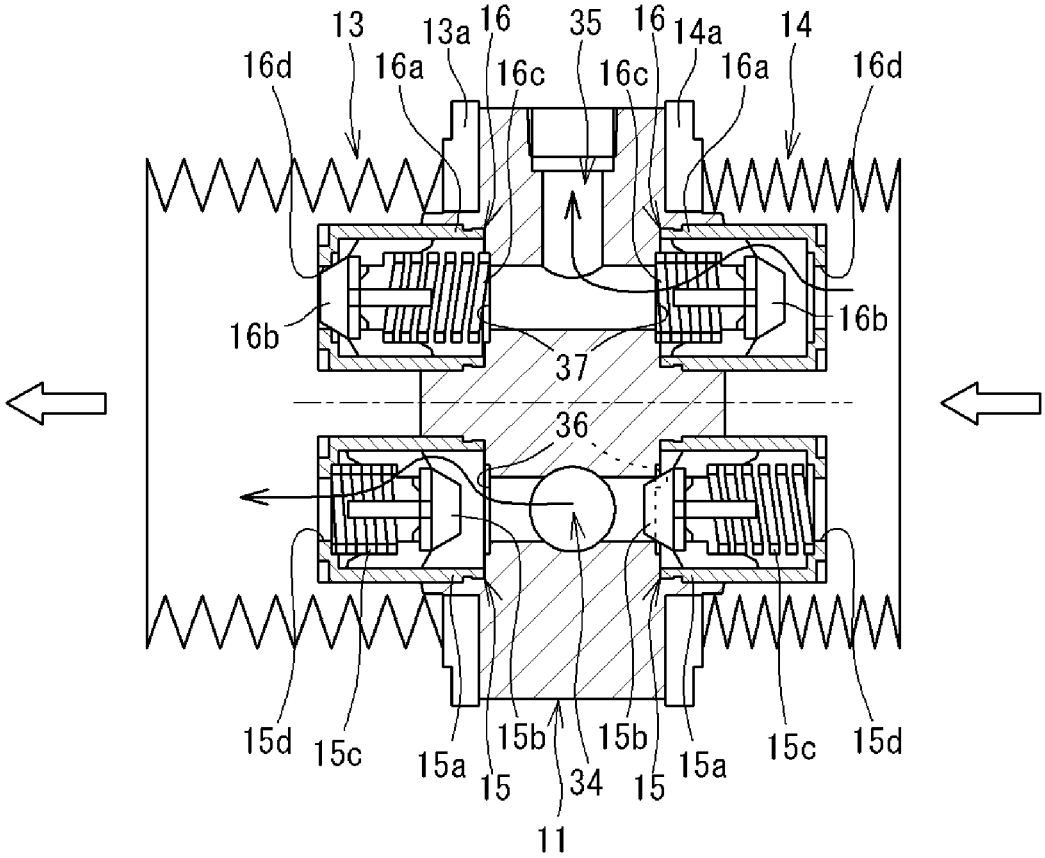
FIG. 4 is an explanatory diagram showing operation of the bellows pump.

Next, operation of the bellows pump 1 of the present embodiment will be described with reference to FIG. 3 and FIG. 4. In FIG. 3 and FIG. 4, the configurations of the first and second bellows 13 and 14 are shown in a simplified manner.

As shown in FIG. 3, when the first bellows 13 contracts and the second bellows 14 expands, the respective valve bodies 15*b* and 16*b* of the suction check valve 15 and the discharge check valve 16 that are mounted at the left side of the pump head 11 in the drawing receive pressure from the transport fluid within the first bellows 13 and move to the right sides of the respective valve cases 15*a* and 16*a* in the drawing. Accordingly, the suction check valve 15 closes, and the discharge check valve 16 opens, so that the transport fluid within the first bellows 13 is discharged through the discharge passage 35 to the outside of the pump.

Meanwhile, the valve body 15*b* of the suction check valve 15 mounted at the right side of the pump head 11 in the drawing moves to the right side of the valve case 15*a* in the drawing due to a suction effect by the second bellows 14. The valve body 16*b* of the discharge check valve 16 mounted at the right side of the pump head 11 in the drawing moves to the right side of the valve case 16*a* in the drawing due to a suction effect by the second bellows 14 and a pressing effect by the transport fluid discharged from the first bellows 13 to the discharge passage 35. Accordingly, the suction check valve 15 opens, and the discharge check valve 16 closes, so that the transport fluid is sucked from the suction passage 34 into the second bellows 14.

Next, as shown in FIG. 4, when the first bellows 13 expands and the second bellows 14 contracts, the respective valve bodies 15*b* and 16*b* of the suction check valve 15 and the discharge check valve 16 that are mounted at the right side of the pump head 11 in the drawing receive pressure from the transport fluid within the second bellows 14 and move to the left sides of the respective valve cases 15*a* and 16*a* in the drawing. Accordingly, the suction check valve 15 closes, and the discharge check valve 16 opens, so that the transport fluid within the second bellows 14 is discharged through the discharge passage 35 to the outside of the pump.

Meanwhile, the valve body 15*b* of the suction check valve 15 mounted at the left side of the pump head 11 in the drawing moves to the left side of the valve case 15*a* in the drawing due to a suction effect by the first bellows 13. The valve body 16*b* of the discharge check valve 16 mounted at the left side of the pump head 11 in the drawing moves to the left side of the valve case 16*a* in the drawing due to a suction effect by the first bellows 13 and a pressing effect by the transport fluid discharged from the first bellows 13 to the discharge passage 35. Accordingly, the suction check valve 15 opens, and the discharge check valve 16 closes, so that the transport fluid is sucked from the suction passage 34 into the first bellows 13.

By repeatedly performing the above operation, the left and right bellows 13 and 14 can alternately suck and discharge the transport fluid.

[Configurations of Solenoid Valves]

In FIG. 1, the first solenoid valve 4 is composed of, for example, a three-position solenoid switching valve including a pair of solenoids 4*a* and 4*b*. Each of the solenoids 4*a* and 4*b* is configured to be magnetized on the basis of a command signal received from the control unit 6. Accordingly, the first solenoid valve 4 is switched and controlled by the control unit 6. The first solenoid valve 4 switches between supply/discharge of the pressurized air to/from the first discharge-side air chamber 21A and supply/discharge of the pressurized air to/from the first suction-side air chamber 26A in the first air cylinder unit 27.

Specifically, when the solenoid 4*a* is magnetized, the first solenoid valve 4 switches to a state where the pressurized air is supplied to the first discharge-side air chamber 21A and the pressurized air within the first suction-side air chamber 26A is discharged. In addition, when the solenoid 4*b* is magnetized, the first solenoid valve 4 switches to a state where the pressurized air within the first discharge-side air chamber 21A is discharged and the pressurized air is supplied to the first suction-side air chamber 26A.

The second solenoid valve 5 is composed of, for example, a three-position solenoid switching valve including a pair of solenoids 5*a* and 5*b*. Each of the solenoids 5*a* and 5*b* is configured to be magnetized upon reception of a command signal from the control unit 6. Accordingly, the second solenoid valve 5 is switched and controlled by the control unit 6. The second solenoid valve 5 switches between supply/discharge of the pressurized air to/from the second discharge-side air chamber 21B and supply/discharge of the pressurized air to/from the second suction-side air chamber 26B in the second air cylinder unit 28.

Specifically, when the solenoid 5*a* is magnetized, the second solenoid valve 5 switches to a state where the pressurized air is supplied to the second discharge-side air chamber 21B and the pressurized air within the second suction-side air chamber 26B is discharged. In addition, when the solenoid 5*b* is magnetized, the second solenoid valve 5 switches to a state where the pressurized air within the second discharge-side air chamber 21B is discharged and the pressurized air is supplied to the second suction-side air chamber 26B.

Although each of the first and second solenoid valves 4 and 5 of the present embodiment is composed of the three-position solenoid switching valve, each of the first and second solenoid valves 4 and 5 may be a two-position solenoid switching valve which does not have a neutral position.

[Configurations of Electropneumatic Regulators]

The first electropneumatic regulator 51 is disposed between the mechanical regulator 3 and the first solenoid valve 4. The first electropneumatic regulator 51 adjusts the air pressure of the pressurized air to be supplied to the first suction-side air chamber (first fluid chamber) 26A of the first air cylinder unit 27 and the air pressure of the pressurized air to be supplied to the first discharge-side air chamber 21A of the first air cylinder unit 27.

Similarly, the second electropneumatic regulator 52 is disposed between the mechanical regulator 3 and the second solenoid valve 5. The second electropneumatic regulator 52 adjusts the air pressure of the pressurized air to be supplied to the second suction-side air chamber (second fluid chamber) 26B of the second air cylinder unit 28 and the air pressure of the pressurized air to be supplied to the second discharge-side air chamber 21B of the second air cylinder unit 28.

The electropneumatic regulators 51 and 52 only have to adjust at least the air pressure of the pressurized air to be supplied to the suction-side air chambers 26A and 26B. In addition, in the present embodiment, the electropneumatic regulators 51 and 52, which directly adjust the air pressure, are used as fluid pressure adjustment units, but the air pressure may be adjusted indirectly using an air flow rate adjusting valve which adjusts an air flow rate, or a device that adjusts the pressure or flow rate of a gas other than air (for example, nitrogen), a liquid, or the like may be used.

[Configuration of Control Unit]

In FIG. 1 and FIG. 2, the control unit 6 is configured to include a computer having a CPU or the like. When the operation command is inputted from the operation switch 7 to the control unit 6, the control unit 6 starts the operation of the bellows pump device 1 after performing initial control, and performs drive control in which the bellows pump 10 is driven. Each function of the control unit 6 is performed by executing a control program stored in a storage device of the computer by the CPU.

The control unit 6 performs first initial control and second initial control in this order as the initial control.

In the first initial control, the control unit 6 switches the first solenoid valve 4 to supply the pressurized air to the first suction-side air chamber 26A of the first air cylinder unit 27 in advance, thereby determining a first operation air pressure (first operation fluid pressure) P1 which is the air pressure of the pressurized air to be supplied to the first suction-side air chamber 26A during operation of the bellows pump device 1 (during drive control).

Specifically, the control unit 6 outputs a control command to the first electropneumatic regulator 51 so as to switch the first solenoid valve 4 to gradually increase the air pressure of the pressurized air to be supplied to the first suction-side air chamber 26A in advance. Then, when the first bellows 13 expands to the most expanded position and a detection signal is inputted from the proximity sensor 29B to the control unit 6, the control unit 6 determines the air pressure of the pressurized air supplied to the first suction-side air chamber 26A at that time, as the first operation air pressure P1.

In the second initial control, the control unit 6 switches the second solenoid valve 5 to supply the pressurized air to the second suction-side air chamber 26B of the second air cylinder unit 28 in advance, thereby determining a second operation air pressure (second operation fluid pressure) P2 which is the air pressure of the pressurized air to be supplied to the second suction-side air chamber 26B during operation of the bellows pump device 1.

Specifically, the control unit 6 outputs a control command to the second electropneumatic regulator 52 so as to switch the second solenoid valve 5 to gradually increase the air pressure of the pressurized air to be supplied to the second suction-side air chamber 26B in advance. Then, when the second bellows 14 expands to the most expanded position and a detection signal is inputted from the proximity sensor 31B to the control unit 6, the control unit 6 determines the air pressure of the pressurized air supplied to the second suction-side air chamber 26B at that time, as the second operation air pressure P2.

The control unit 6 of the present embodiment performs the second initial control after performing the first initial control. However, the control unit 6 may perform the first initial control after performing the second initial control, or may simultaneously perform the first initial control and the second initial control.

As the drive control, the control unit 6 controls drive of each of the first air cylinder unit 27 and the second air cylinder unit 28 of the bellows pump 10 by switching the respective solenoid valves 4 and 5 on the basis of detection signals from the proximity sensors 29 and 31.

Specifically, on the basis of detection signals from the proximity sensors 29 and 31, the control unit 6 controls drive of the first and second air cylinder units 27 and 28 such that: the second bellows 14 is caused to contract from the most expanded position before the first bellows 13 reaches the most contracted position; and the first bellows 13 is caused to contract from the most expanded position before the second bellows 14 reaches the most contracted position.

Here, the term "before" the first bellows 13 reaches the most contracted position means that a contraction progress position of the first bellows 13 is closer to a contraction end position (most contracted position) than to a contraction start position (most expanded position), and more specifically means a position where the first bellows 13 has contracted up to 60% to 90% (preferably 60% to 70%, more preferably 66%) of a contraction length from the most expanded position to the most contracted position. Similarly, the term "before" the second bellows 14 reaches the most contracted position means that a contraction progress position of the second bellows 14 is closer to a contraction end position (most contracted position) than to a contraction start position (most expanded position), and more specifically means a position where the second bellows 14 has contracted up to 60% to 90% (preferably 60% to 70%, more preferably 66%) of a contraction length from the most expanded position to the most contracted position.

Accordingly, at a time of switching from contraction of one bellows to expansion thereof (from discharge of the transport fluid to suction thereof), the other bellows has already contracted to discharge the transport fluid. Thus, great fall of the discharge pressure of the transport fluid at the time of switching can be reduced. As a result, pulsation at the discharge side of the bellows pump 10 can be reduced.

Before the one bellows 13 (14) reaches the most contracted position, the control unit 6 of the present embodiment causes the other bellows 14 (13) to contract from the most expanded position. However, the control unit 6 may perform control such that when the one bellows 13 (14) reaches the most contracted position, the other bellows 14 (13) is caused to contract from the most expanded position. From the viewpoint of reducing the pulsation at the discharge side of the bellows pump 10, it is preferable to perform control as in the present embodiment.

[Control Example of Initial Control and Drive Control]

Figure 5:
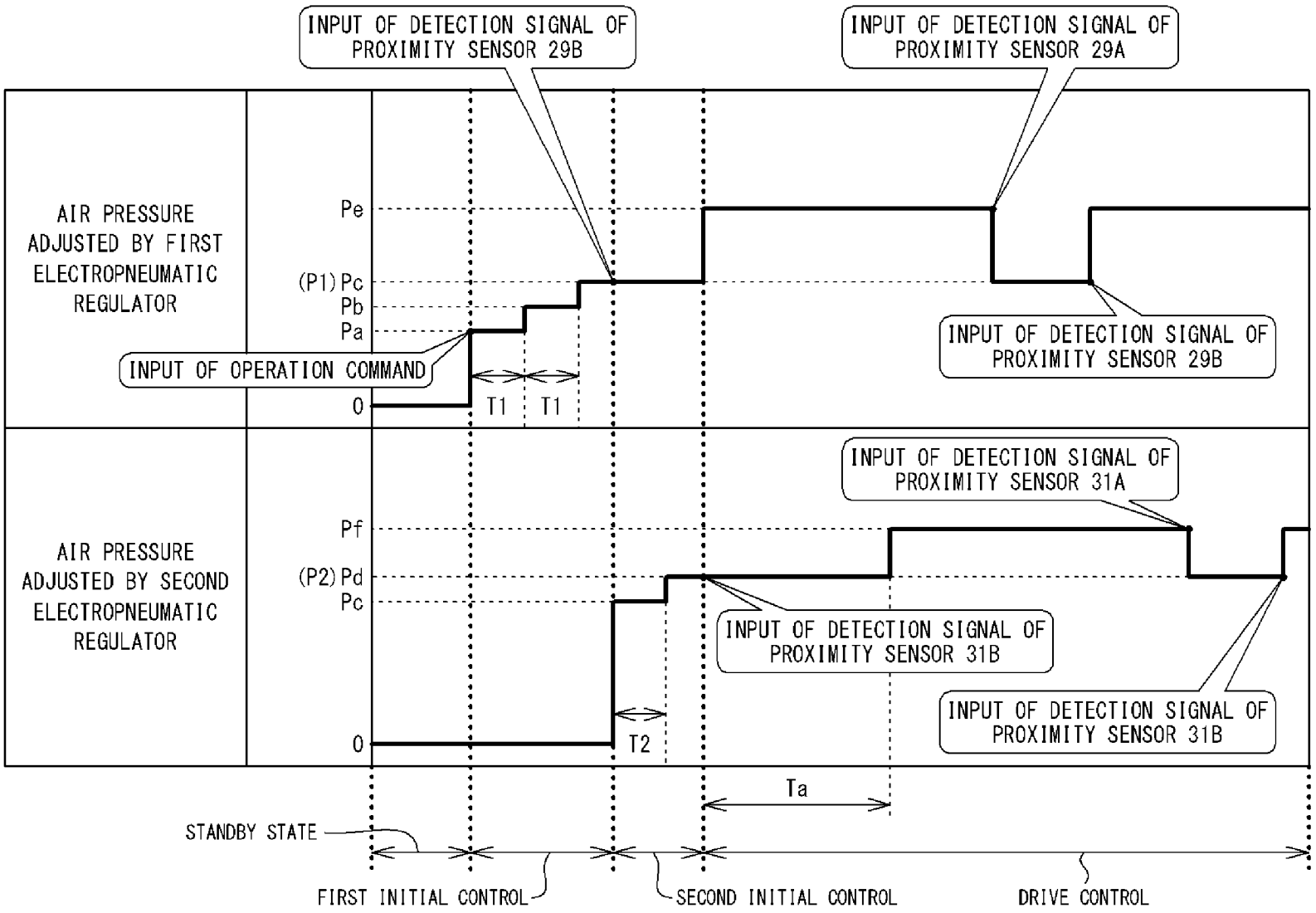
FIG. 5 is a time chart showing a control example of initial control and drive control by a control unit.

FIG. 5 is a time chart showing a control example of the initial control and the drive control by the control unit 6 of the present embodiment. Hereinafter, the initial control and the drive control executed by the control unit 6 will be described with reference to FIG. 1 and FIG. 5. The control unit 6 waits for input of the operation command from the operation switch 7 in a standby state. In the standby state, the first bellows 13 and the second bellows 14 are each in a natural length state.

When the operation command is inputted from the operation switch 7 to the control unit 6, the control unit 6 initially executes the first initial control. In the first initial control, the control unit 6 starts supplying pressurized air (hereinafter, also referred to as first pressurized air) from the air supply device 2 to the first suction-side air chamber 26A of the first air cylinder unit 27 by switching the first solenoid valve 4. At that start point, the control unit 6 outputs a control command to the first electropneumatic regulator 51 so as to adjust the air pressure of the first pressurized air to a predetermined primary air pressure Pa.

Next, the control unit 6 waits for input of a detection signal from the proximity sensor 29B until a fixed time T1 elapses from the start point. The fixed time T1 is set, for example, to a time that is slightly longer than an expansion time taken until the first bellows 13 reaches the most expanded position from the most contracted position during normal operation.

Therefore, when the air pressure of the first pressurized air is equal to or higher than the air pressure required to cause the first bellows 13 to expand, the first bellows 13 expands, and thus a detection signal is inputted from the proximity sensor 29B to the control unit 6 before the fixed time T1 elapses.

On the other hand, when the air pressure of the first pressurized air is less than the air pressure required to cause the first bellows 13 to expand, the first bellows 13 does not expand, and thus a detection signal is not inputted from the proximity sensor 29B to the control unit 6 even when the fixed time T1 elapses.

If no detection signal is inputted from the proximity sensor 29B within the fixed time T1, the control unit 6 outputs a control command to the first electropneumatic regulator 51 so as to adjust the air pressure of the first pressurized air to a secondary air pressure Pb which is higher than the primary air pressure Pa by a predetermined pressure. As described above, the control unit 6 outputs a control command to the first electropneumatic regulator 51 so as to increase the first pressurized air stepwise by the predetermined pressure every fixed time T1 until a detection signal is inputted from the proximity sensor 29B.

In the control example of FIG. 5, the case where a detection signal is inputted from the proximity sensor 29B to the control unit 6 within the fixed time T1 when the air pressure of the first pressurized air is a tertiary air pressure Pc, is shown. When a detection signal is inputted from the proximity sensor 29B to the control unit 6, the control unit 6 determines the air pressure of the first pressurized air at that time (here, the tertiary air pressure Pc) as the first operation air pressure P1. Then, the control unit 6 outputs a control command to the first electropneumatic regulator 51 so as to maintain the air pressure of the first pressurized air at the first operation air pressure P1, and ends the first initial control.

The control unit 6 executes the first initial control when an operation command is inputted from the operation switch 7 to the control unit 6, but may execute the first initial control when an operation command is inputted from a dedicated switch, which is provided separately from the operation switch 7, to the control unit 6.

The control unit 6 executes the second initial control after the first initial control ends. In the second initial control, the control unit 6 starts supplying pressurized air (hereinafter, also referred to as second pressurized air) from the air supply device 2 to the second suction-side air chamber 26B of the second air cylinder unit 28 by switching the second solenoid valve 5. At that start point, the control unit 6 outputs a control command to the second electropneumatic regulator 52 so as to adjust the air pressure of the second pressurized air to a predetermined primary air pressure. The control unit 6 of the present embodiment outputs a control command to the second electropneumatic regulator 52 so as to adjust the primary air pressure of the second initial control to the first operation air pressure P1 (Pc) determined in the first initial control.

Next, the control unit 6 waits for input of a detection signal from the proximity sensor 31B until a fixed time T2 elapses from the start point. The fixed time T2 is set, for example, to a time that is slightly longer than an expansion time taken until the second bellows 14 reaches the most expanded position from the most contracted position during normal operation.

Therefore, when the air pressure of the second pressurized air is equal to or higher than the air pressure required to cause the second bellows 14 to expand, the second bellows 14 expands, and thus a detection signal is inputted from the proximity sensor 31B to the control unit 6 before the fixed time T2 elapses.

On the other hand, when the air pressure of the second pressurized air is less than the air pressure required to cause the second bellows 14 to expand, the second bellows 14 does not expand, and thus a detection signal is not inputted from the proximity sensor 31B to the control unit 6 even when the fixed time T2 elapses.

If no detection signal is inputted from the proximity sensor 31B within the fixed time T2, the control unit 6 outputs a control command to the second electropneumatic regulator 52 so as to adjust the air pressure of the second pressurized air to a secondary air pressure Pd which is higher than the primary air pressure Pc by a predetermined pressure. As described above, the control unit 6 outputs a control command to the second electropneumatic regulator 52 so as to increase the second pressurized air stepwise by the predetermined pressure every fixed time T2 until a detection signal is inputted from the proximity sensor 31B.

In the control example of FIG. 5, the case where a detection signal is inputted from the proximity sensor 31B to the control unit 6 within the fixed time T2 when the air pressure of the second pressurized air is the secondary air pressure Pd, is shown. When a detection signal is inputted from the proximity sensor 31B to the control unit 6, the control unit 6 determines the air pressure of the second pressurized air at that time (here, the secondary air pressure Pd) as the second operation air pressure P2, and ends the second initial control.

In each of the first initial control and the second initial control, the control unit 6 increases the pressurized air to be supplied to the suction-side air chamber 26A or 26B stepwise by the predetermined pressure every fixed time, but may output a control command to the electropneumatic regulator 51 or 52 so as to continuously increase this air pressure.

However, in this case, also in a period from the time at which the pressurized air to be supplied to the suction-side air chamber 26A or 26B rises to the air pressure (appropriate air pressure) required to cause the bellows 13 or 14 to expand to the expansion position to the time at which the bellows 13 or 14 expands to the expansion position, the pressurized air continuously rises. Therefore, if the air pressure of the pressurized air supplied to the suction-side air chamber 26A or 26B at the time at which the bellows 13 or 14 reaches the expansion position and a detection signal of the proximity sensor 29B or 31B is inputted to the control unit 6 is set as the operation air pressure P1 or P2, the operation air pressure P1 or P2 is slightly higher than the appropriate air pressure. Therefore, when the air pressure is increased stepwise as in the present embodiment, a value closer to the appropriate air pressure can be determined as the operation air pressure P1 or P2.

In the present embodiment, the first and second operation air pressures P1 and P2 are automatically determined by using the electropneumatic regulators 51 and 52, but the first and second operation air pressures may be determined by manually adjusting the air pressures of the first pressurized air and the second pressurized air using a mechanical regulator.

Figure 6:
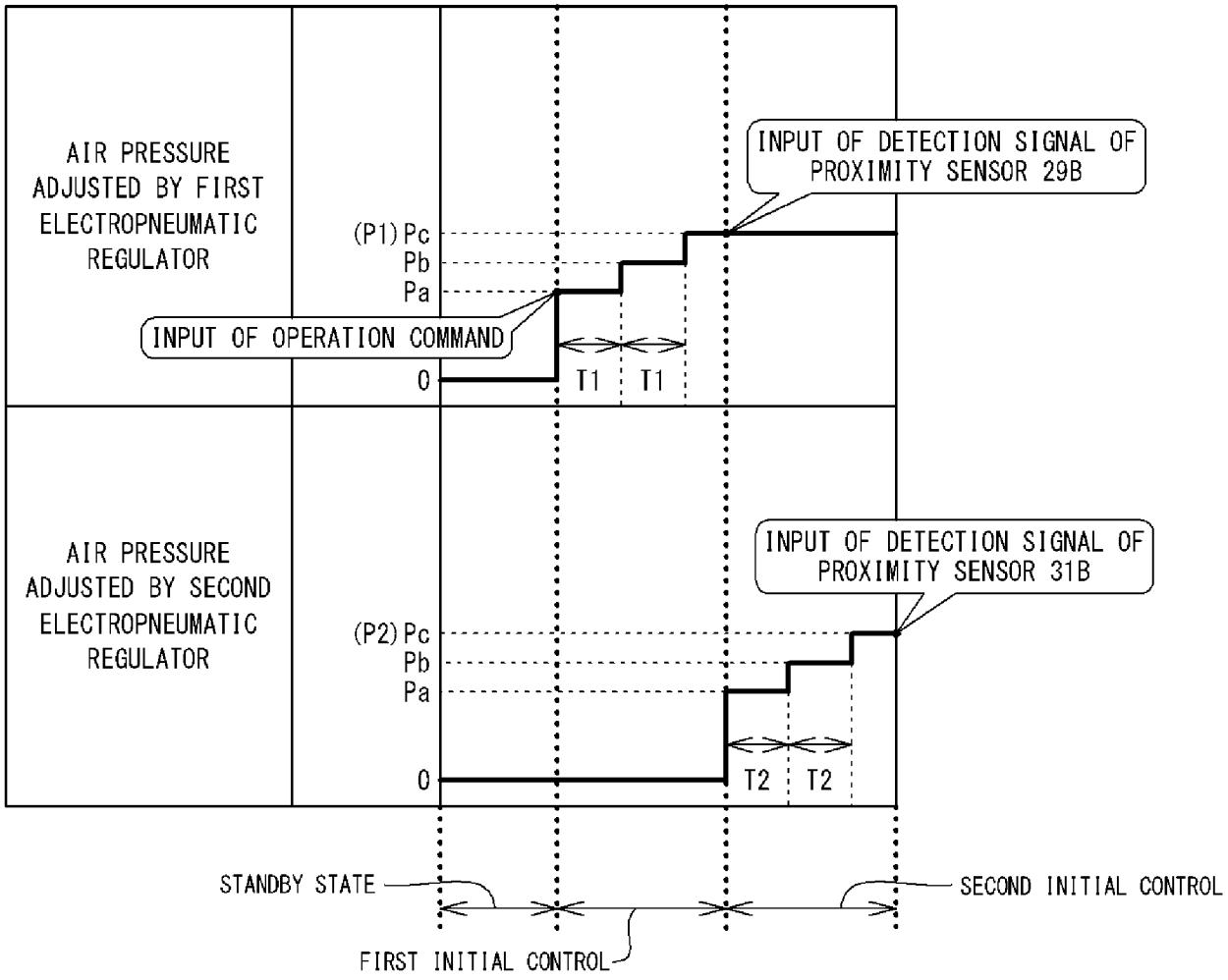
FIG. 6 is a time chart showing a modification of the initial control.

FIG. 6 is a time chart showing a modification of the initial control. In the present modification, the control unit 6 outputs a control command to the second electropneumatic regulator 52 so as to adjust the primary air pressure of the second pressurized air in the second initial control to the primary air pressure Pa which is used in the first initial control. Control subsequent thereto is performed in the same procedure as the control example of FIG. 5.

In the control example of FIG. 6, the case where a detection signal is inputted from the proximity sensor 31B to the control unit 6 within the fixed time T2 when the air pressure of the second pressurized air is the tertiary air pressure Pc, is shown. Therefore, when a detection signal is inputted from the proximity sensor 31B to the control unit 6, the control unit 6 of the present modification determines the tertiary air pressure Pc, which is the air pressure of the second pressurized air at that time, as the second operation air pressure P2, and ends the second initial control.

Referring back to FIG. 5, the control unit 6 executes the drive control after the second initial control ends. In the drive control, when a detection signal is inputted from the proximity sensor 31B to the control unit 6 at the end of the second initial control, the control unit 6 switches the first solenoid valve 4 to start supplying the pressurized air from the air supply device 2 to the first discharge-side air chamber 21A. At that time, the control unit 6 outputs a control command to the first electropneumatic regulator 51 so as to adjust the air pressure of the pressurized air to a predetermined air pressure Pe. The air pressure Pe is set to the air pressure required to cause the first bellows 13 to contract. Accordingly, the first bellows 13 starts contracting from the most expanded position.

Next, when a predetermined time Ta elapses from the time at which a detection signal of the proximity sensor 31B is inputted to the control unit 6, and the first bellows 13 contracts to a position that is before the most contracted position, the control unit 6 switches the second solenoid valve 5 to start supplying the pressurized air from the air supply device 2 to the second discharge-side air chamber 21B. At that time, the control unit 6 outputs a control command to the second electropneumatic regulator 52 so as to adjust the air pressure of the pressurized air to a predetermined air pressure Pf. The air pressure Pf is set to the air pressure required to cause the second bellows 14 to contract. Accordingly, the second bellows 14 starts contracting from the most expanded position before the first bellows 13 reaches the most contracted position.

Next, when the first bellows 13 contracts to the most contracted position and a detection signal is inputted from the proximity sensor 29A to the control unit 6, the control unit 6 switches the first solenoid valve 4 to start supplying the pressurized air from the air supply device 2 to the first suction-side air chamber 26A. At that time, the control unit 6 outputs a control command to the first electropneumatic regulator 51 so as to adjust the air pressure of the pressurized air to the first operation air pressure P1. Accordingly, the first bellows 13 starts expanding from the most contracted position.

Next, when: the second bellows 14 contracts to a position that is before the most contracted position; and the first bellows 13 expands to the most expanded position and a detection signal is inputted from the proximity sensor 29B to the control unit 6, the control unit 6 switches the first solenoid valve 4 to start supplying the pressurized air from the air supply device 2 to the first discharge-side air chamber 21A. At that time, the control unit 6 outputs a control command to the first electropneumatic regulator 51 so as to adjust the air pressure of the pressurized air to the air pressure Pe again. Accordingly, the first bellows 13 starts contracting from the most expanded position before the second bellows 14 reaches the most contracted position.

Next, when the second bellows 14 contracts to the most contracted position and a detection signal is inputted from the proximity sensor 31A to the control unit 6, the control unit 6 switches the second solenoid valve 5 to start supplying the pressurized air from the air supply device 2 to the second suction-side air chamber 26B. At that time, the control unit 6 outputs a control command to the second electropneumatic regulator 52 so as to adjust the air pressure of the pressurized air to the second operation air pressure P2. Accordingly, the second bellows 14 starts expanding from the most contracted position.

Next, when the second bellows 14 expands to the most expanded position and a detection signal is inputted from the proximity sensor 31B to the control unit 6, the control unit 6 switches the second solenoid valve 5 to start supplying the pressurized air from the air supply device 2 to the second discharge-side air chamber 21B. At that time, the control unit 6 outputs a control command to the first electropneumatic regulator 51 so as to adjust the air pressure of the pressurized air to the air pressure Pf again. Accordingly, the second bellows 14 starts contracting from the most expanded position.

After that, as described above, on the basis of detection signals from the proximity sensors 29 and 31, the control unit 6 repeatedly performs control in which the control unit 6 switches the solenoid valves 4 and 5 and outputs control commands to the electropneumatic regulators 51 and 52.

As described above, in the bellows pump device 1 of the present embodiment, before the operation is started, the control unit 6 performs the initial control in which the pressurized air is supplied to the suction-side air chambers 26A and 26B in advance, thereby determining the operation air pressures which are the air pressures of the pressurized air to be supplied to the suction-side air chambers 26A and 26B during the operation. At that time, the control unit 6 outputs control commands to the electropneumatic regulators 51 and 52 so as to gradually increase the air pressure of the pressurized air, and when the bellows 13 and 14 expand to the most expanded position and detection signals are inputted from the proximity sensors 29B and 31B to the control unit 6, the control unit 6 determines the air pressures of the pressurized air supplied to the suction-side air chambers 26A and 26B at that time, as the operation air pressures. Accordingly, the operation air pressures become values near the appropriate air pressures required to cause the bellows 13 and 14 to expand to the expansion position. Therefore, an impact pressure and the like can be inhibited from being generated when the transport fluid is sucked into the bellows 13 and 14 at the start of the operation.

The control unit 6 outputs control commands to the electropneumatic regulators 51 and 52 so as to increase stepwise the air pressure of the pressurized air to be supplied to the suction-side air chambers 26A and 26B in advance, and thus values closer to the appropriate air pressures can be determined as the operation air pressures as compared to the case of continuously increasing the air pressure.

When an operation command to start operation is inputted from the operation switch to the control unit 6, the control unit 6 starts the operation after performing the initial control, so that the control unit 6 can assuredly perform the initial control before starting the operation of the bellows pump device 1.

When the first bellows 13 and the second bellows 14 expand and contract independently of each other as in the present embodiment, the control unit 6 can simultaneously perform the first initial control and the second initial control. However, since the first bellows 13 and the second bellows 14 are caused to alternately expand during actual operation, when the first initial control and the second initial control are simultaneously performed, the first bellows 13 and the second bellows 14 simultaneously expand. Therefore, when the first initial control and the second initial control are simultaneously performed, the negative pressure in each bellows 13, 14 becomes larger than that during actual operation, and the air pressure of the pressurized air required to cause each bellows 13, 14 to expand to the most expanded position becomes higher than the appropriate air pressure required during actual operation. Accordingly, the first operation air pressure and the second operation air pressure determined by the control unit 6 are also higher than the appropriate air pressure.

On the other hand, in the present embodiment, since the second initial control is performed after the first initial control is performed, the first operation air pressure and the second operation air pressure can be determined in the same environment as during actual operation. As a result, the control unit 6 can determine values closer to the appropriate air pressure as the first and second operation air pressures, as compared to the case where the first initial control and the second initial control are simultaneously performed.

In the second initial control, the control unit 6 outputs a control command so as to gradually increase the air pressure of the pressurized air to be supplied to the second suction-side air chamber 26B in advance from the first operation air pressure determined in the first initial control, so that the control unit 6 can quickly determine the second operation air pressure in the second initial control.

[Others]

The present invention is also applicable to other bellows pumps such as a bellows pump in which one of a pair of bellows is replaced with an accumulator, in addition to the bellows pump 10 of the above embodiment.

The embodiment disclosed herein is merely illustrative and not restrictive in all aspects. The scope of the present disclosure is defined by the scope of the claims rather than the meaning described above, and is intended to include meaning equivalent to the scope of the claims and all modifications within the scope.

REFERENCE SIGNS LIST

1 bellows pump device
4 first solenoid valve (solenoid valve)
5 second solenoid valve (solenoid valve)
6 control unit
7 operation switch
13 first bellows (bellows)
14 second bellows (bellows)
26A first suction-side air chamber (fluid chamber, first fluid chamber)
26B second suction-side air chamber (fluid chamber, second fluid chamber)
29B proximity sensor (detection unit, first detection unit)
31B proximity sensor (detection unit, second detection unit)
51 first electropneumatic regulator (fluid pressure adjustment unit, first fluid pressure adjustment unit)
52 second electropneumatic regulator (fluid pressure adjustment unit, second fluid pressure adjustment unit)
P1 first operation air pressure (operation fluid pressure, first operation fluid pressure)
P2 second operation air pressure (operation fluid pressure, second operation fluid pressure)

The invention claimed is:

1. A bellows pump device comprising a fluid chamber to and from which a pressurized fluid is supplied and discharged and an expandable/contractible bellows, the bellows expanding to a predetermined expansion position and a transport fluid being sucked into the bellows when the pressurized fluid is supplied to the fluid chamber, the bellows contracting and the transport fluid within the bellows being discharged when the pressurized fluid is discharged from the fluid chamber, the bellows pump device further comprising:

a solenoid valve configured to switch supply/discharge of the pressurized fluid to/from the fluid chamber;

a fluid pressure adjustment unit configured to adjust a fluid pressure of the pressurized fluid to be supplied to the fluid chamber;

a detection unit configured to detect that the bellows is at the expansion position, and output a detection signal; and a control unit configured to, before operation of the bellows pump device is started, perform initial control in which the solenoid valve is switched and the pressurized fluid is supplied to the fluid chamber in advance, thereby determining an operation fluid pressure which is the fluid pressure of the pressurized fluid to be supplied to the fluid chamber during the operation, wherein as the initial control, the control unit outputs a control command to the fluid pressure adjustment unit so as to gradually increase the fluid pressure of the pressurized fluid to be supplied to the fluid chamber in advance, and when the detection signal is inputted from the detection unit to the control unit, the control unit determines the fluid pressure of the pressurized fluid supplied to the fluid chamber at that time as the operation fluid pressure.

2. The bellows pump device according to claim 1, wherein the control unit outputs a control command to the fluid pressure adjustment unit so as to increase stepwise the fluid pressure of the pressurized fluid to be supplied to the fluid chamber in advance.

3. The bellows pump device according to claim 1, further comprising an operation switch configured to output an operation command to start the operation, wherein when the operation command is inputted to the control unit, the control unit starts the operation after performing the initial control.

4. The bellows pump device according to claim 1, wherein the bellows pump device comprises a first fluid chamber and a second fluid chamber as the fluid chamber, the bellows pump device comprises, as the bellows, a first bellows configured to suck and discharge the transport fluid when the pressurized fluid is supplied to and discharged from the first fluid chamber and a second bellows expandable/contractible independently of the first bellows and configured to suck and discharge the transport fluid when the pressurized fluid is supplied to and discharged from the second fluid chamber, the bellows pump device comprises, as the solenoid valve, a first solenoid valve configured to switch supply/discharge of the pressurized fluid to/from the first fluid chamber and a second solenoid valve configured to switch supply/discharge of the pressurized fluid to/from the second fluid chamber, the bellows pump device comprises, as the fluid pressure adjustment unit, a first fluid pressure adjustment unit configured to adjust the fluid pressure of the pressurized fluid to be supplied to the first fluid chamber and a second fluid pressure adjustment unit configured to adjust the fluid pressure of the pressurized fluid to be supplied to the second fluid chamber, the bellows pump device comprises, as the detection unit, a first detection unit configured to detect that the first bellows is at the expansion position and output a detection signal and a second detection unit configured to detect that the second bellows is at the expansion position and output a detection signal, as the initial control, the control unit performs first initial control in which the first solenoid valve is switched and the pressurized fluid is supplied to the first fluid chamber in advance, thereby determining a first operation fluid pressure which is the fluid pressure of the pressurized fluid to be supplied to the first fluid chamber during the operation, and second initial control in which the second solenoid valve is switched and the pressurized fluid is supplied to the second fluid chamber in advance, thereby determining a second operation fluid pressure which is the fluid pressure of the pressurized fluid to be supplied to the second fluid chamber during the operation, as the first initial control, the control unit outputs a control command to the first fluid pressure adjustment unit so as to gradually increase the fluid pressure of the pressurized fluid to be supplied to the first fluid chamber in advance, and when the detection signal is inputted from the first detection unit to the control unit, the control unit determines the fluid pressure of the pressurized fluid supplied to the first fluid chamber at that time as the first operation fluid pressure, and as the second initial control, the control unit outputs a control command to the second fluid pressure adjustment unit so as to gradually increase the fluid pressure of the pressurized fluid to be supplied to the second fluid chamber in advance, and when the detection signal is inputted from the second detection unit to the control unit, the control unit determines the fluid pressure of the pressurized fluid supplied to the second fluid chamber at that time as the second operation fluid pressure.

5. The bellows pump device according to claim 4, wherein the control unit performs the second initial control after performing the first initial control.

6. The bellows pump device according to claim 5, wherein, in the second initial control, the control unit outputs the control command so as to gradually increase the fluid pressure of the pressurized fluid to be supplied to the second fluid chamber in advance from the first operation fluid pressure determined in the first initial control.

* * * * *